United States Patent [19]

Ottino

[11] Patent Number: 4,988,135

[45] Date of Patent: Jan. 29, 1991

[54] LOAD-INCREASABLE ELECTRICALLY OPERATED LOCK, PARTICULARLY FOR AUTOMOTIVE APPLICATION

[75] Inventor: Franco G. Ottino, San Giuliano Terme, Italy

[73] Assignee: Roltra Morse S.p.A., Cascine Vica-Rivoli, Italy

[21] Appl. No.: 474,275

[22] Filed: Feb. 2, 1990

[30] Foreign Application Priority Data

Feb. 3, 1989 [IT] Italy ..... 67062 A/89

[51] Int. Cl.[5] ..... E05C 3/26

[52] U.S. Cl. ..... 292/201; 292/210; 292/216

[58] Field of Search ..... 292/98, 197, 201, 216, 292/210

[56] References Cited

U.S. PATENT DOCUMENTS

| | | | |
|---|---|---|---|
| 1,585,144 | 5/1926 | Hannebahn | 292/98 |
| 3,566,703 | 3/1971 | Van Noord | 292/201 X |
| 3,664,698 | 5/1972 | Stropkay | 292/201 |
| 3,884,056 | 5/1975 | East et al. | 292/197 X |
| 4,622,902 | 11/1986 | Miller | 220/324 X |
| 4,815,775 | 3/1989 | Martin et al. | 292/201 |
| 4,951,979 | 8/1990 | Escarovage | 292/201 X |

*Primary Examiner*—Richard E. Moore

*Attorney, Agent, or Firm*—Klauber & Jackson

[57] ABSTRACT

An electrically operated lock for a motor vehicle door, comprising a latch designed to engage, when closed, a striker fitted to a fixed portion of the vehicle; a retainer designed to cooperate with and maintain the latch in the closed position by virtue of elastic means; mechanical means for activating the retainer; and control means activated by an electric actuator, secured to the retainer, and designed to provide for reversible displacement of the retainer for further rotating the latch from the closed position to a further closed position wherein the load on the door seals is increased.

17 Claims, 10 Drawing Sheets

LOAD-INCREASABLE ELECTRICALLY OPERATED LOCK, PARTICULARLY FOR AUTOMOTIVE APPLICATION

BACKGROUND OF THE INVENTION

The present invention relates to an electrically operated lock, particularly for motor vehicle doors. It should be pointed out that, in the following description and claims, the term "door" is used in the general sense to indicate both the front and rear side doors and the rear door of the vehicle.

More and more vehicles are being fitted with electrically operated locks which, with very little effort on the part of the user, provide for high locking loads and, consequently, high compression loads on the door seals, thus improving passenger comfort by reducing noise and air intrusion.

Known locks of the aforementioned type usually comprise a latch mounted for rotation on a pin integral with the vehicle door, and designed to move between an unlatched position and a fully latched position wherein it engages a striker secured to the vehicle frame; a retainer loaded by elastic means and designed to cooperate with and maintain said latch in the latched position; linkages for enabling mechanical release and the safety function; and electric activating means.

Said electric activating means usually provide for automatically closing the latch when the door is pushed to and the latch set to what is generally referred to as the "secondary latched" position, wherein the retainer engages the latch in less than the fully closed position. Commencing from said secondary latched position, the latch is turned further into a position in excess of the fully latched position, so as to enable engagement of the retainer via said elastic means.

Known locks of the aforementioned type present a number of drawbacks.

First and foremost is the risk element involved in said electric activating means operating in said secondary latched position, wherein the door is still slightly ajar and fingers or objects may inadvertently be trapped between the door and vehicle body when said electric activating means are operated.

Secondly, due to the fairly steep load-distortion curve of the door seals when subjected to maximum compression, rotation of the latch in excess of the fully latched position places considerable extra load on the electric activating means, which must thus be oversized.

Thirdly, known locks of the aforementioned type are fairly noisy, due to the latch being sprung back sharply by said elastic means from the overtravel to the fully latched position.

SUMMARY OF THE INVENTION

The aim of the present invention is to provide an electrically operated lock designed to overcome the drawbacks typically associated with known locks of the aforementioned type.

With this aim in view, according to the present invention, there is provided an electrically operated lock for the door of a motor vehicle having peripheral elastic sealing means designed to cooperate in sealing manner with said door, said lock comprising:

a latch pivoting on a pin integral with said door, and designed to move between a first open position and a second closed position wherein it engages a respective striker on a fixed portion of said vehicle:

a retainer designed to cooperate with and maintain said latch in said closed position by virtue of elastic means;

means for mechanically activating said retainer;

electric activating means; and means for controlling said electric activating means;

characterised by the fact that it comprises control means activated by said electric activating means and secured to said retainer; said control means being designed to provide for reversible movement of said retainer for further rotating said latch from said second closed position to a third closed position wherein the load on said peripheral sealing means is increased.

BRIEF DESCRIPTION OF THE DRAWINGS

A preferred non-limiting embodiment of the invention will be described by way of example with reference to the accompanying drawings, in which.

DETAILED DESCRIPTION OF THE INVENTION

Figure 1:
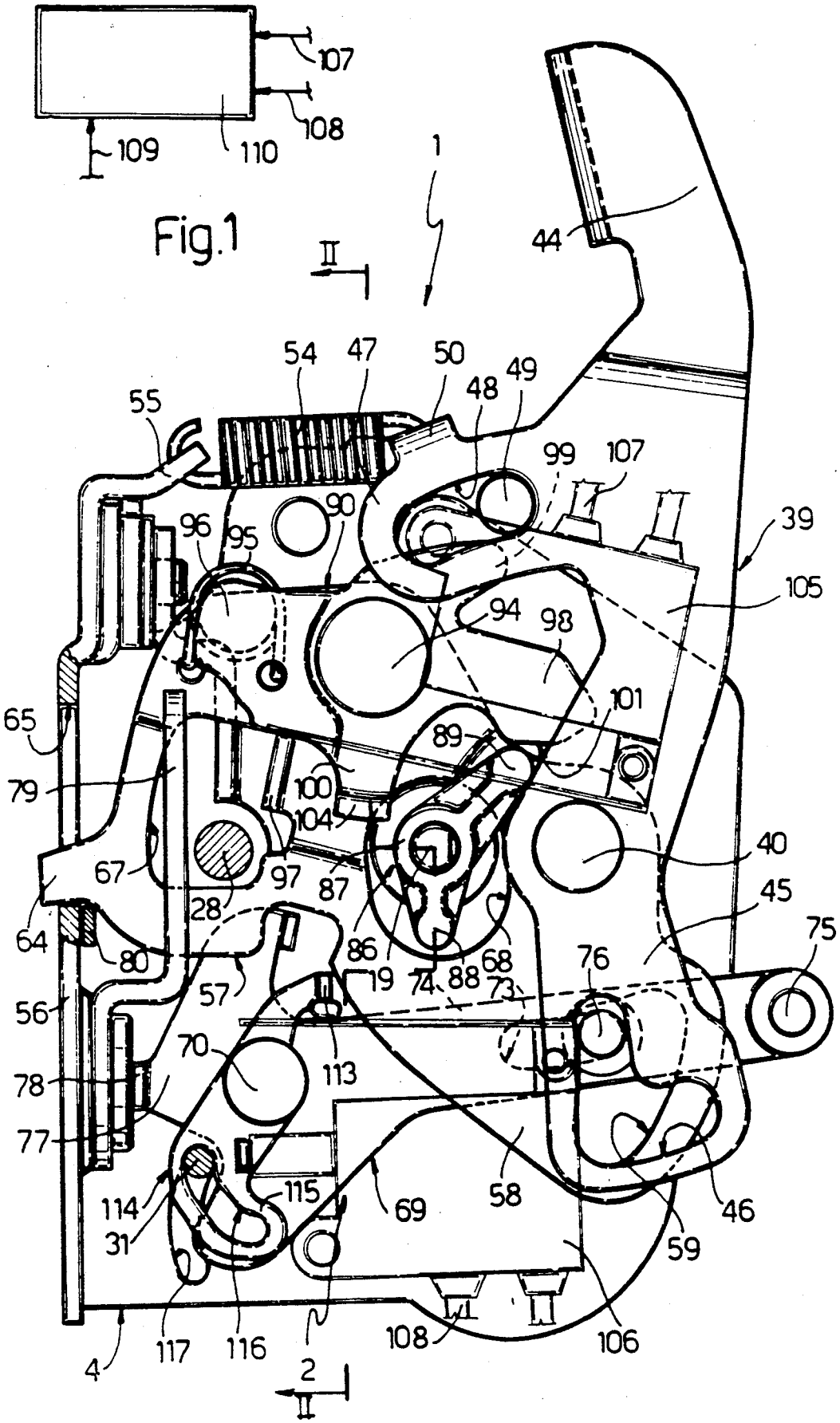
FIG. 1 shows an elevation of a lock in accordance with the teachings of the present invention.
Figure 2:
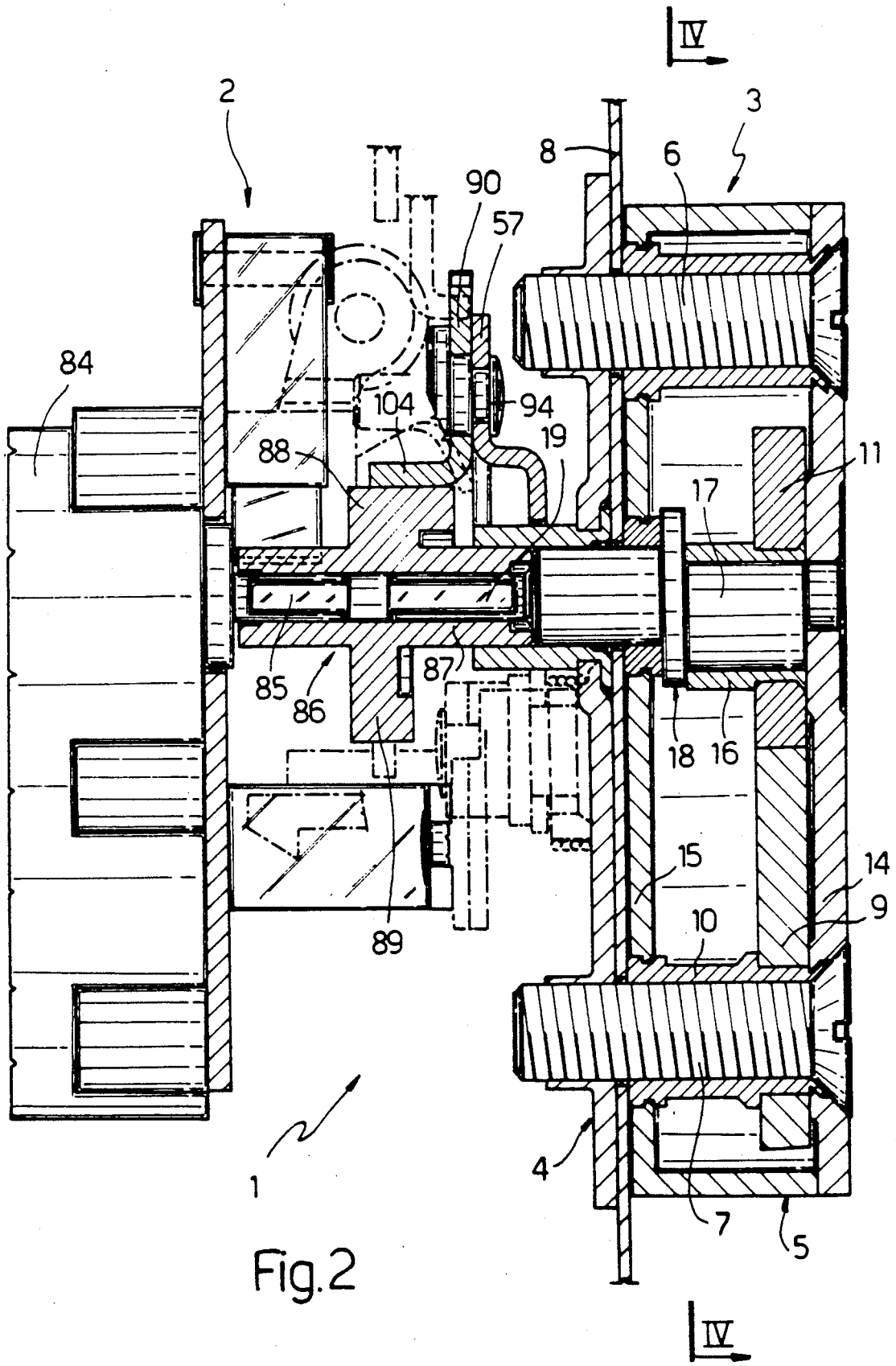
FIG. 2 shows a section of the FIG. 1 lock along line II—II in a different operating position.
Figure 3:
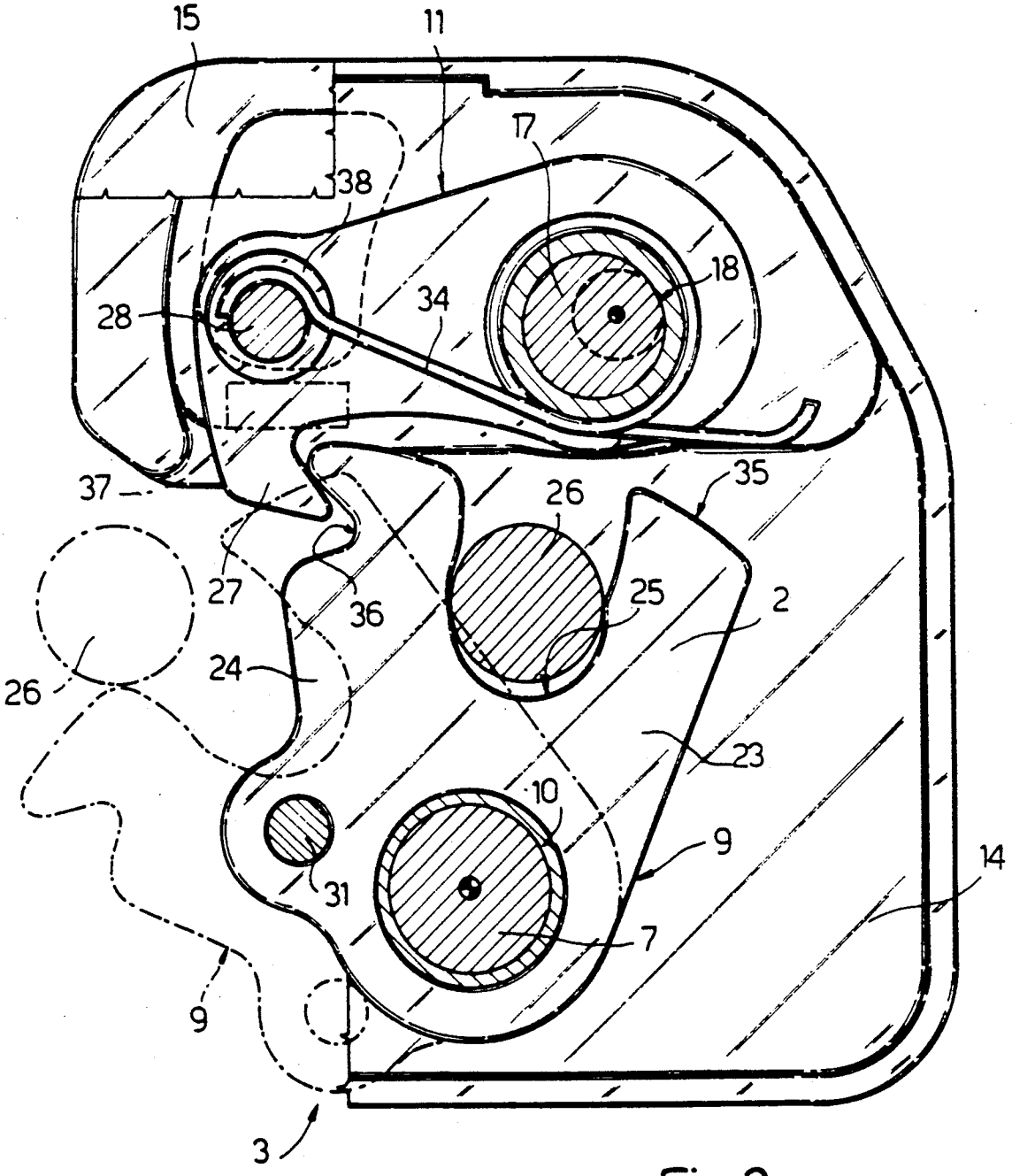
FIGS. 3 and 4 show sections along line IV—IV in FIG. 2 in two different operating positions.
Figure 4:
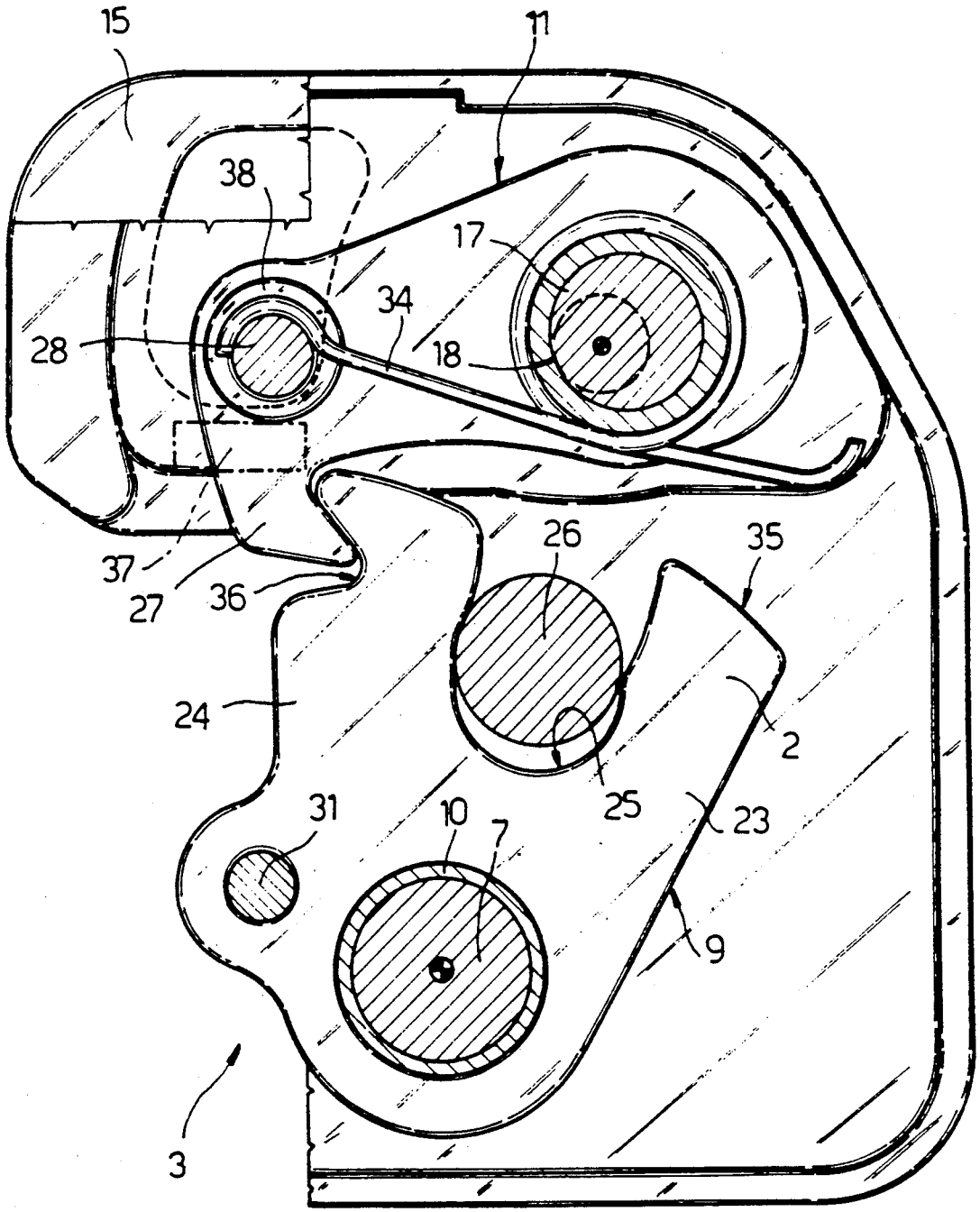

Number 1 in FIGS. 1 to 3 indicates an electrically operated lock for the door of a motor vehicle (not shown) fitted in known manner with elastic seals cooperating with the edge of the door when closed.

Lock 1 comprises a first unit 2 mounted, in use, inside the bodywork of the door, and a second unit 3 mounted, in use, outside the bodywork. Said first and second units 2 and 3 comprise respective supporting members 4 and 5 gripped together by means of three screws (only two of which numbered 6 and 7 are shown in FIG. 2) on opposite sides of door panel 8.

Said member 5 supporting said second unit 3 is substantially in the form of a box of constant thickness having substantially flat parallel opposite walls 14 and 15, and houses a latch 9 pivoting on a bush 10 coaxial with bottom screw 7 and secured between walls 14 and 15, and a substantially normal hook-shaped retainer 11 pivoting via bush 16 on an eccentric portion 17 of pin 18 supported on walls 14 and 15. Pin 18 presents an end portion 19 projecting from unit 3 into unit 2 for the purpose described in detail later on.

Latch 9 presents a pair of arms 23, 24 defining a U-shaped recess 25, and is designed to move between an open position, wherein said recess 25 faces laterally outwards of unit 3 for receiving a cylindrical striker 26 secured appropriately and in projecting manner to the door pillar, and a fully closed position (as shown by the continuous line in FIG. 3) wherein said arms 23 and 24 are turned substantially upwards and striker 26 is housed between the same.

Close to a lateral edge of latch 9, on the arm 24 side of the same, there extends a pin 31 having its axis parallel to the hinge axis of latch 9 and extending axially inside unit 2.

Latch 9 is forced into said open position by conventional elastic means (not shown).

Retainer 11, which is flat and elongated substantially horizontally, comprises a downturned hook-shaped end 27 and a transverse pin 28 fitted close to said end 27. Said pin 28 extends axially from unit 3 into unit 2, and is loaded by a spring 34 wound about bush 16 and designed to maintain retainer 11 engaged with latch 9. In said closed position, end 27 of retainer 11 cooperates with a front surface 35 of arm 23 of latch 9, said surface 35 conveniently sloping for enabling mutual slide during rotation of latch 9. An outer portion of arm 24, opposite recess 25, presents a seat 36 designed to receive end 27 of retainer 11 in the closed position. Wall 14 presents a stop 37 with which cooperates a cylindrical enlargement 38 at the base of pin 28 for angularly arresting retainer 11 by virtue of spring 34. Unit 2 comprises a number of linkages, most of which are of conventional type and therefore described only briefly.

Unit 2 comprises an elongated opening control lever 39 pivoting on a pin 40 secured to supporting member 4, and having a long top arm 44 and a bottom arm 45 with a substantially L-shaped through slot 46. Top arm 44 presents a lateral appendix 47 having a curved slot 48 engaged in sliding manner by a pin 49 secured to supporting member 4, and a bent top projection 50 to which is secured a helical spring 54 secured at the opposite end to an appendix 55 of lateral wall 56 of supporting member 4. Spring 54 is designed to maintain lever 39 substantially vertical (FIGS. 1, 9) by virtue of one end of slot 48 contacting pin 49.

On the same pin 40, there also pivots an opening control lever 57 of fairly complex design as shown in FIGS. 5 to 8.

Opening control lever 57 presents an arm 58 overlapping bottom arm 45 of lever 39 and having a substantially rounded triangular through slot 59 with its apex pointing downwards. A second arm 60 of lever 57 presents an end tooth 64 sliding vertically in an opening 65 in lateral wall 56 of supporting member 4; and two shaped through openings 67, 68 corresponding respectively with pins 28 and 18 of retainer 11. Lever 57 is forced anticlockwise (as shown in the drawings) by elastic means (not shown) into a stop position defined by tooth 64 contacting the bottom end of opening 65.

Unit 2 also comprises a safety lever 69 (shown only partially) pivoting on a pin 70 secured to supporting member 4. Said safety lever 69 comprises an arm 74 extending substantially horizontally along the bottom portion of unit 2, and having an end 75 projecting laterally outwards of lock 1 and controlled in known manner by means of a key from outside the vehicle.

Said arm 74 presents a slot 73 housing a sliding pin 76 which also engages L-shaped slot 46 on control lever 39 and slot 59 on opening control lever 57. Safety lever 69 also comprises an opposite arm 77 terminating, close to wall 56, with a tooth 78 to which is secured one end (not shown) of a further in-vehicle safety control lever 79 (shown only partially) pivoting on wall 56.

Unit 2 also comprises a known type of in-vehicle opening control lever substantially in the form of a square and pivoting on wall 56. Of said lever, FIG. 1 shows a section of end tooth 80 designed to cooperate upwards with tooth 78 of safety lever 69.

Lock 1 according to the present invention comprises an electric actuator 84 (FIG. 2) secured to supporting member 4 and having an output shaft 85 coaxial with and facing end portion 19 of pin 18 on retainer 11. Actuator 84, which presents a known internal structure (not shown), comprises a d.c. motor, a reduction gear, and an encoder for detecting the rotation angles of output shaft 85 (or any other rotary member of actuator 84).

Shaft 85 and pin 18 are connected angularly by a control member 86 substantially presenting a hollow tubular portion 87, the opposite ends of which are engaged prismatically by shaft 85 and end 19 of pin 18, and a pair of respectively short and long radial cam projections 88, 89 forming an obtuse angle conveniently ranging from 120° to 150°. Said projections 88 and 89 present substantially flat converging sides, and are designed to cooperate with a selective connecting lever 90 pivoting via pin 94 on the top portion of arm 60 of opening control lever 57, and designed to move in relation to the same between a first and second limit position (shown respectively by the dotted and continuous lines in FIG. 6); both said limit positions being rendered stable by a helical spring 95 secured at the ends to lever 57 and arm 96 of lever 90. Lever 90 also comprises an arm 98 opposite arm 96 and having a sloping contact surface 101 designed to cooperate with projection 89 of control member 86 as described in more detail later on. The central portion of selective connecting lever 90 presents a sloping rounded top tooth 99, and a bottom projection 100 having an end tab 104 bent 90°. Said limit positions of lever 90 are defined respectively by one side of arm 96 and projection 100 contacting a tab 97 perpendicular to the edge of opening 67 on lever 57.

Lock 1 comprises a pair of enabling microswitches 105, 106, which, together with the encoder of actuator 84, are connected via respective leads 107, 108, 109 to an electronic control system 110 (shown schematically in FIG. 1) located on the vehicle and designed to control supply of the electric motor in known manner.

Microswitch 105 is conveniently of the normally-open type, and is activated for supplying an enabling signal by lever 57 via tab 97. Microswitch 106 is activated by the top end 113 of a lever 114 pivoting on pin 70, and the bottom arm 115 of which presents a shaped slot 116 engaged in sliding manner by said pin 31 on latch 9, which extends inside unit 2 through a curved opening 117 on supporting member 4.

Slot 116 is so shaped that travel of pin 31 along opening 117 turns lever 114 about pin 70, thus tripping microswitch 106. This is conveniently of the normally-closed type, designed to produce an enabling signal when lever 114 is turned anticlockwise (as shown in FIG. 1).

Lock 1 operates as follows.

The dotted line in FIG. 3 shows the position of latch 9 when lock 1 is open. In this position, the eccentric portion 17 of pin 18 is offset, in relation to the axis of pin 18, towards the hook-shaped end 27 of retainer 11; and pin 31 is located at the bottom end of opening 117, securing lever 114 in the clockwise-rotated position (no signal).

When the door is pushed to, the inner side of arm 23 of latch 9 contacts striker 26 and turns (clockwise in FIG. 3) into the secondary latched position shown by the continuous line. By virtue of spring 34, the hook-shaped end 27 of retainer 11 clicks into seat 36 on arm 24 of latch 9, which is thus locked in said secondary latched position. It will be observed that the stop position of retainer 11 is determined by enlargement 38 on pin 28 contacting stop 37, as opposed to engagement with latch 9.

Latch 9 and retainer 11 are so sized and connected that said secondary latched position is achieved with minimum compression of the door seals and, therefore, minimum effort on the part of the user, while at the same time positioning the edge of the door practically flush with the rest of the vehicle body. In other words, as regards mutual engagement of retainer 11 and latch 9, said position is tantamount to the fully latched position, the only difference being the very modest load exerted on the door seals.

As latch 9 moves into said secondary latched position, pin 31 moves to the top end of opening 117, thus turning lever 114 and tripping microswitch 106. The resulting enabling signal activates control system 110, which supplies actuator 84 for turning shaft 85 anticlockwise.

The eccentric portion 17 of pin 18 turns about the axis of pin 18, taking retainer 11 with it, which is secured by spring 34 so as to slide over stop 37. End 27 of retainer 11 is therefore moved approximately linearly, maximum excursion being reached subsequent to 180° rotation of actuator 84 corresponding to an inversion of the eccentricity of portion 17 in relation to the axis of pin 18. As it is displaced, retainer 11 turns latch 9 further by a lesser amount, but sufficient to bring the vehicle door and frame closer together and so compress the door seals as required.

In other words, said electric activating means provide, not for closing the lock, which is already achieved mechanically, but for increasing load over and above that obtainable manually.

For the sake of simplicity, the effect of said electric activating means on the unit 2 linkages during closure will be described in detail later on.

Figure 5:
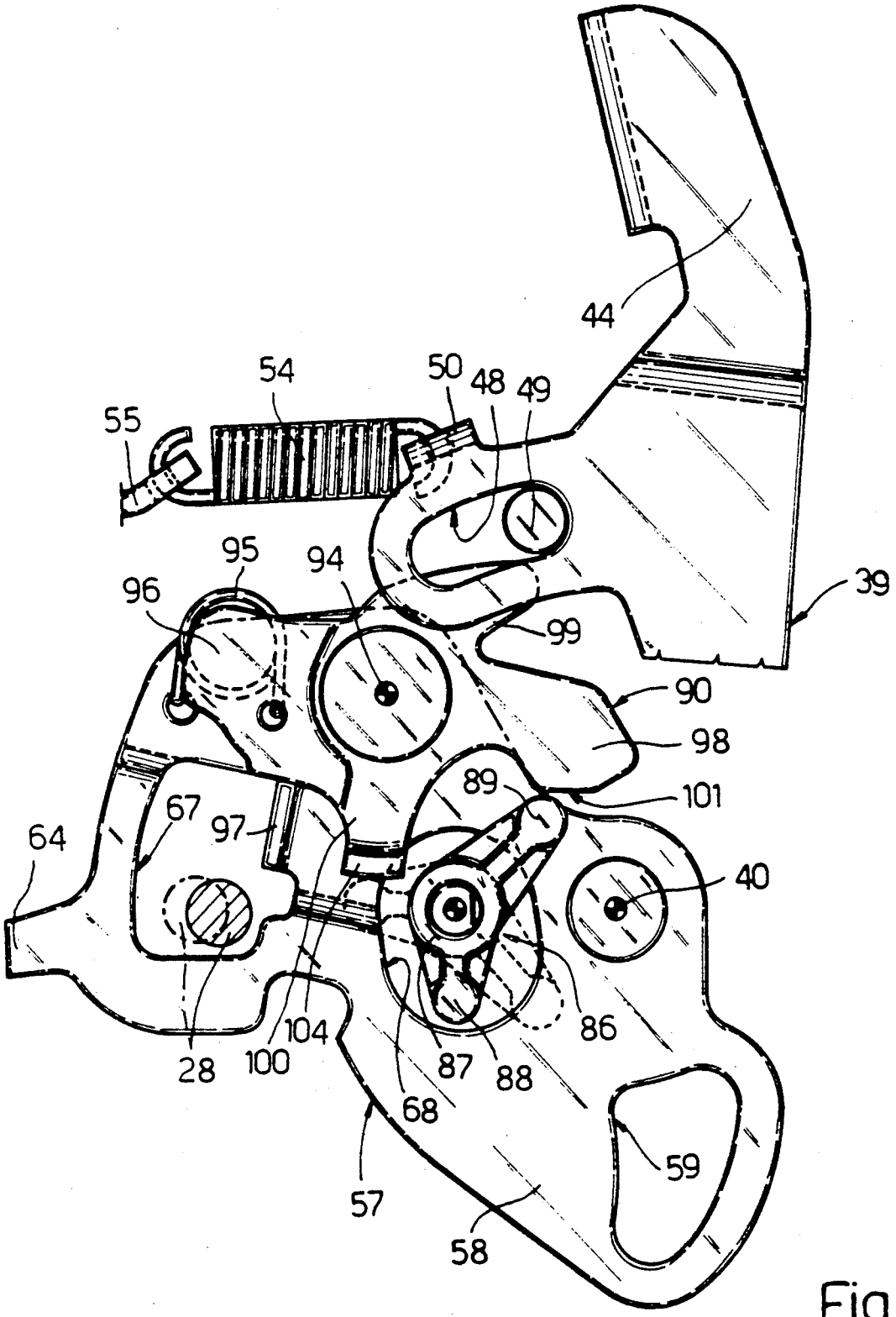
FIGS. 5, 6, 7, 8, 9 and 10 show part views of the FIG. 1 lock in various operating positions.
Figure 6:
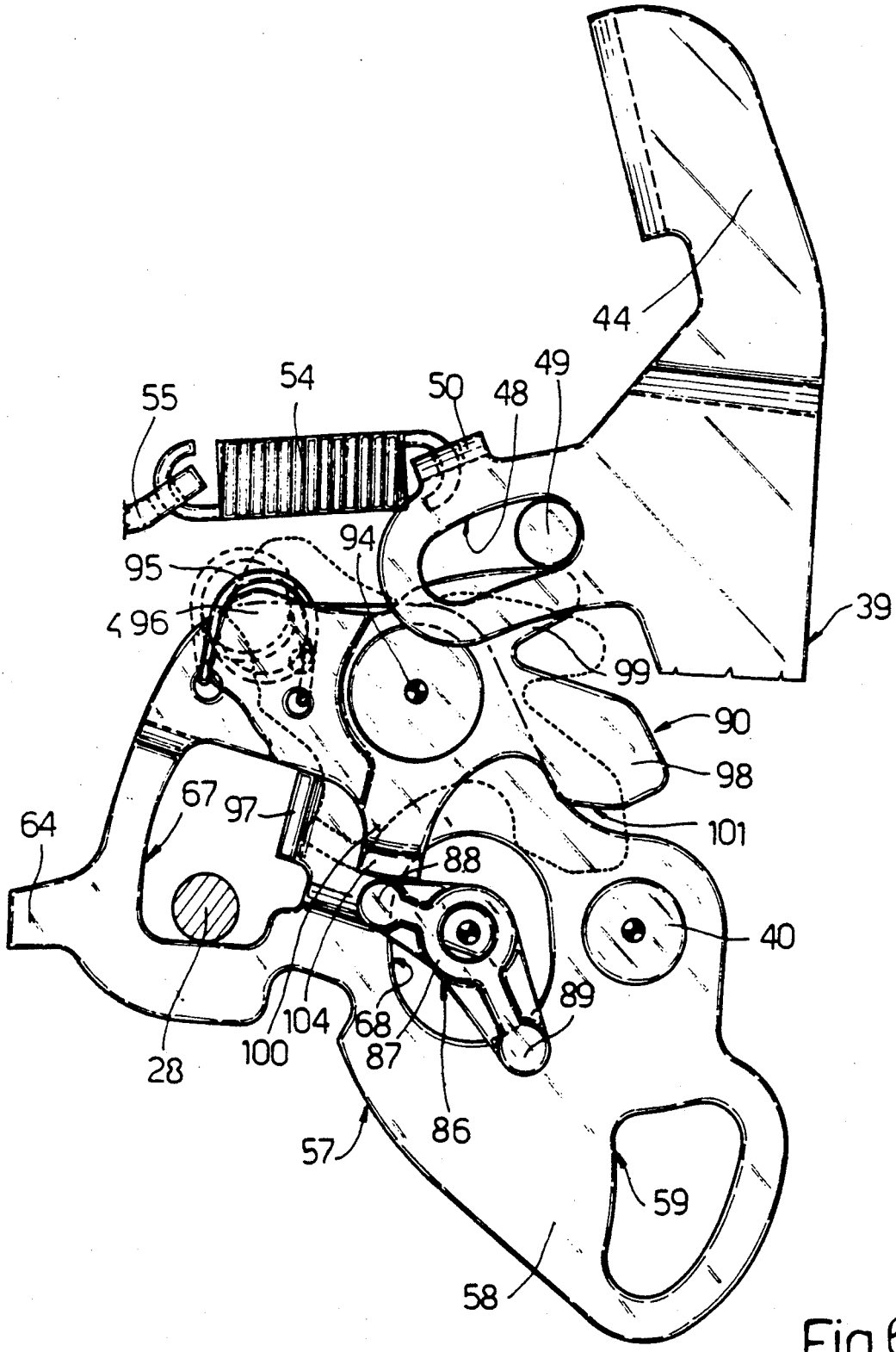
Figure 7:
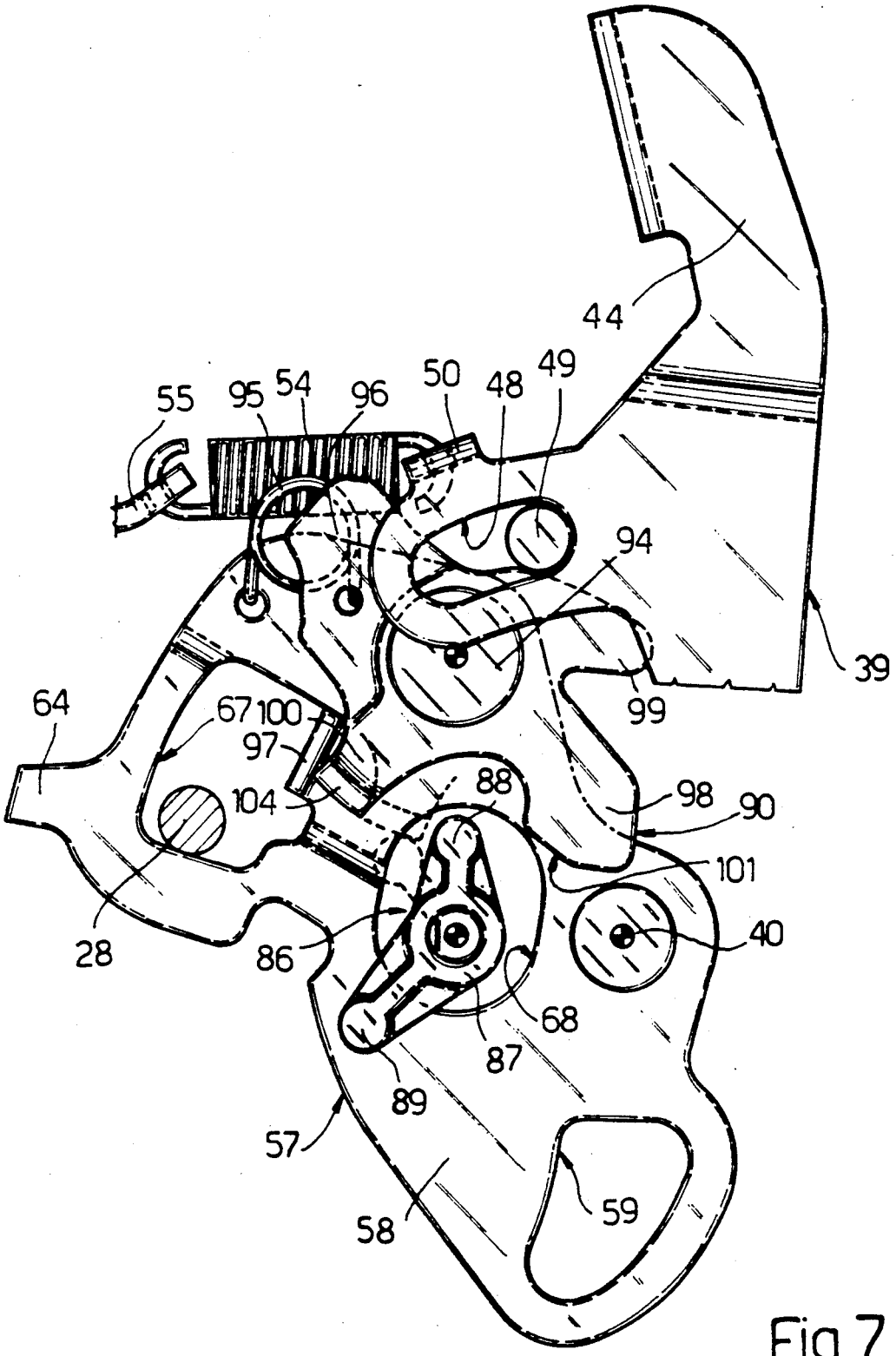
Figure 8:
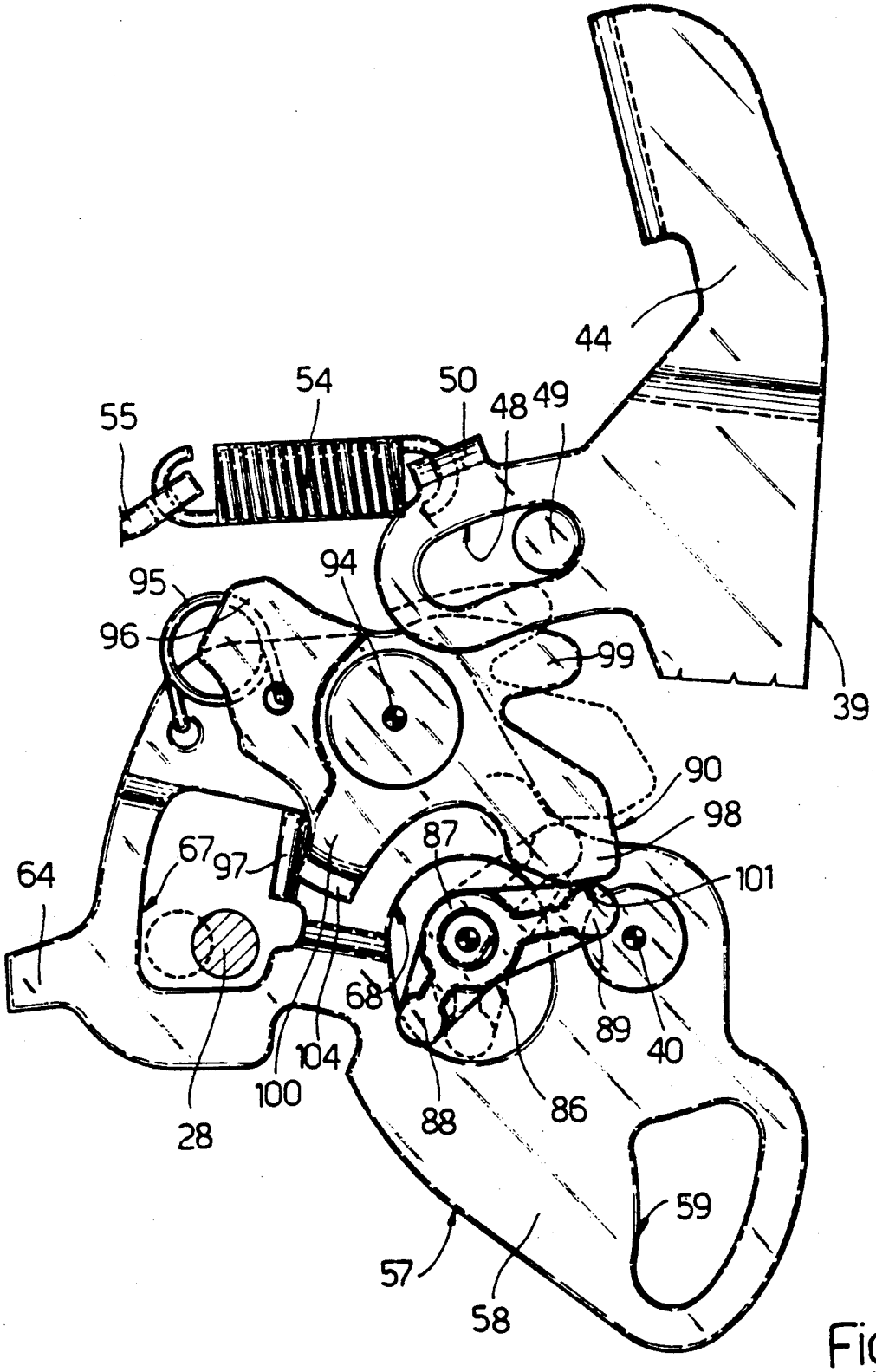

Upon actuator 84 completing said 180° rotation, this is detected by the encoder, and actuator 84 is arrested by control system 110, at which point, the unit 2 members are arranged as shown in FIG. 1 or, more clearly, in FIG. 5 in which only the parts involved are illustrated.

Lock 1 is opened fully automatically by means of an external handle (acting on lever 39) or an internal handle (acting on said internal control lever).

More specifically, when safety lever 74 is in the raised position (shown by the continuous line in FIG. 9), pin 76 engages the top portion of slot 46 on opening control lever 39 with substantially no side clearance, and cooperates with the lateral edge of slot 59 on opening control lever 57. Said levers 39 and 57 are thus connected together so that, when control lever 39 is operated, both levers are turned integral with each other about common hinge pin 40.

Similarly, lever 57 is turned by said internal control lever via said tooth 80.

In either case, the slightest rotation of lever 57 causes tab 97 to cooperate with and trip microswitch 105, which supplies an opening enabling signal to control system 110.

Control system 110 then activates actuator 84 in reverse (clockwise as shown in the drawings) so as to turn control member 86 and pin 18.

Rotation of pin 18, particularly portion 17 of the same, about its axis shifts retainer 11 in the opposite direction to that described in connection with the closing operation, so as to gradually restore latch 9 to the secondary latched position and at the same time reduce the load on the door seals.

For approximately the first 90°, rotation of control member 86 is ineffective, providing for only a partial reduction of the load on the seals.

After approximately 90° rotation, projection 88 of control member 86 contacts tab 104 of selective connecting lever 90 (as shown by the dotted line in FIG. 5), said lever 90, for the reasons given later on, being set at this point to said first position. Subsequent to contact and further rotation of control member 86, levers 90 and 57 are turned integral with each other about pin 40, at first with no relative rotation by virtue of tab 97 on arm 96 of lever 90.

Rotation of lever 57 brings the bottom edge of opening 67 on lever 57 into contact with pin 28 of retainer 11 (FIG. 6) which gradually releases latch 9 into the secondary latched position, and raises pin 28 (FIG. 7) to release retainer 11 and so open latch 9.

During operation of retainer 11 as described above, control member 86 brings tooth 99 of lever 90 into contact with fixed pin 49, thus causing lever 90 to turn gradually clockwise (FIG. 6) in relation to lever 57, and tooth 99 to slide over pin 49. The various components involved are so sized and arranged that, upon retainer 11 being released, lever 90 springs back to said second position (FIGS. 6 and 7), thus detaching tab 104 of lever 90 from control member 86 and restoring retainer 11 and lever 57 to the rest position.

Once lock 1 is fully opened, as determined by 180° rotation of control member 86, actuator 84 is arrested by control system 110, which detects said 180° rotation via the encoder.

The above closing operation, described solely with reference to unit 3, will now be described as related to unit 2.

At the final load increasing stage, reverse rotation (FIG. 8) brings projection 89 of control member 86 into contact with surface 101 on arm 98 of lever 90, which is thus restored to said first position ready for a further opening cycle.

In the event of a fault on the electric system, provision is obviously made for enabling all the lock 1 functions to be performed manually, regardless of the type of fault or the operating stage in which it occurs. Mechanical closure is performed as already described. A fault on the electric system during closure prevents the load on the seals from being increased, and the door remains in the secondary latched position which, being tantamount to the fully latched position, as already stated, poses no problems in terms of safety.

Figure 9:
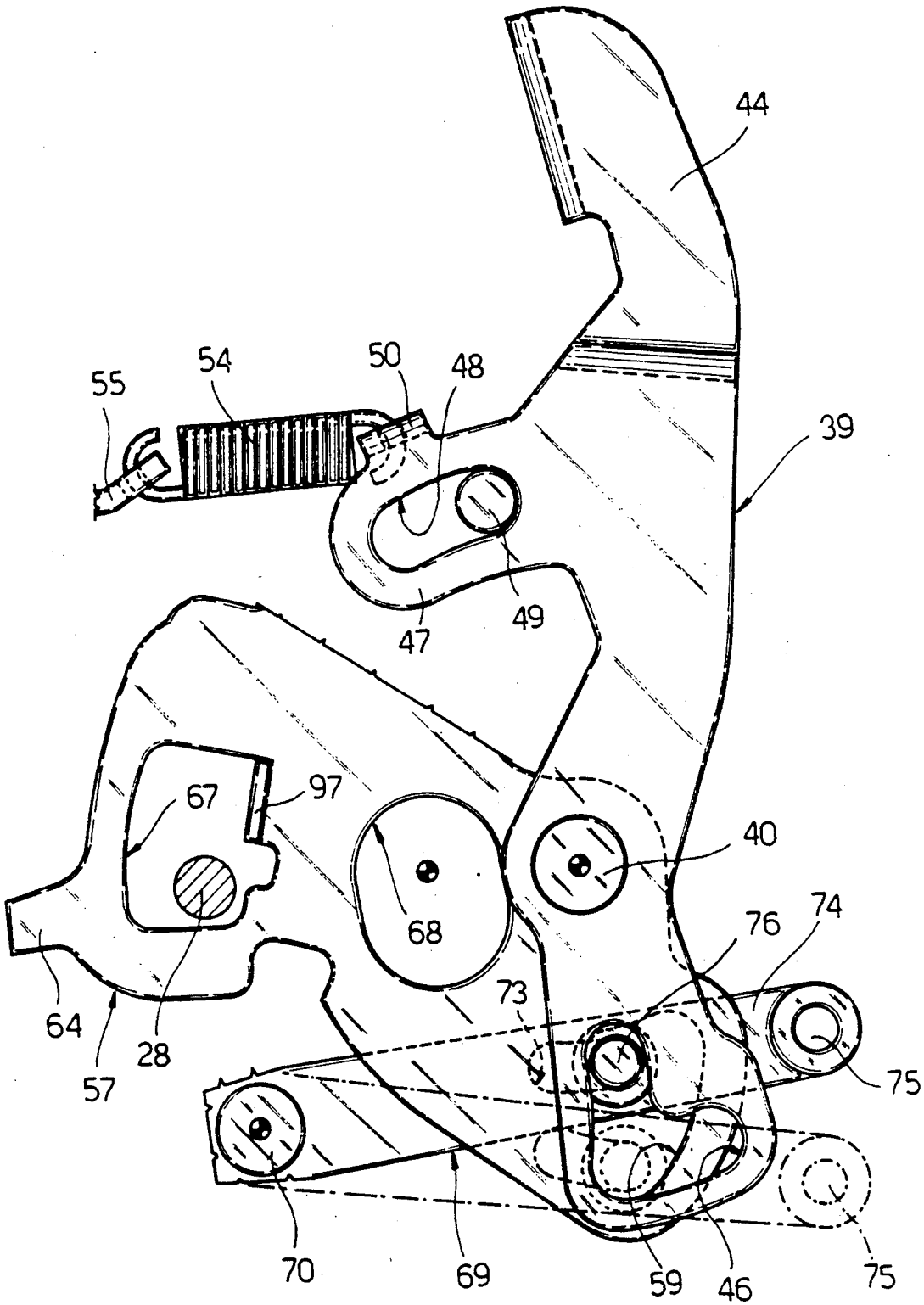
Figure 10:
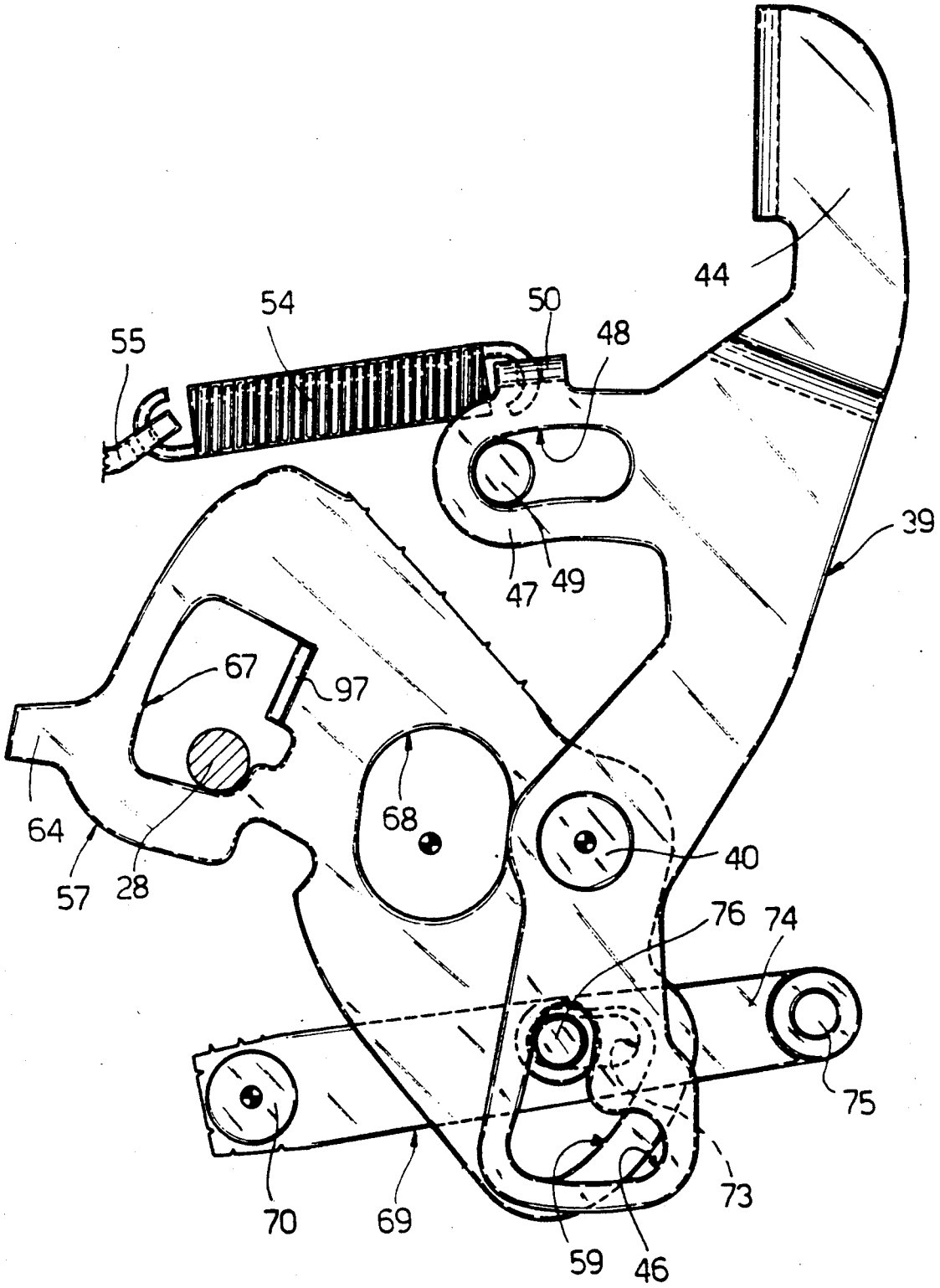

Manual opening and operation of safety lever 74 are shown in FIGS. 9 and 10.

As already stated in connection with the electric opening procedure, manual operation of the external handle acts on lever 39 (providing the safety lever is in the raised position) thus turning lever 57. Should actuator 84 fail to operate, continued manual operation of either of the aforementioned levers causes the bottom edge of opening 67 on lever 57 to raise pin 28 of retainer 11 and so release latch 9. Even when operated manually, rotation of lever 57 into the open position brings selective connecting lever 90 into contact with fixed pin 49, as described in connection with electric operation (FIG. 7), and consequently into said second position. This is essential in terms of reliable emergency operation, by ensuring retainer 11 and lever 57 are restored correctly to the rest position when the lock is opened, and enabling the lock to be closed again.

Lock 1 may also be opened mechanically using said internal control lever, which acts directly on arm 60 of lever 57 regardless of the position of safety lever 74.

When said lever 74 is in the lowered position shown by the dotted line in FIG. 9, pin 56 engages the bottom portion of the L-shaped slot on control lever 39, and any rotation of said lever simply causes pin 56 to slide inside said portion with no effect on lever 57, thus preventing lock 1 from being opened.

Safety lever 74 may be operated from outside the vehicle using a key (which acts on end 75 of lever 74); from inside the vehicle by means of a standard knob (which acts on lever 79 for both connection and disconnection); or by means of an opening handle (which provides solely for disconnection).

The advantages of lock 1 according to the present invention will be clear from the foregoing description.

First and foremost, it provides for maximum safety by virtue of said electric activating means operating subsequent to mechanical closure. The absence of overtravel considerably reduces the maximum load required of the geared motor, and eliminates noise caused by the latch springing back to the closed position, while at the same time ensuring increased load on the door seals when closed. Electrical opening requires very little effort, by virtue of the load on the seals being almost entirely removed when the retainer is released. Moreover, lever 90 provides for separating electrical and emergency mechanical operation, thus requiring very little effort on the part of the user, and enabling intervention at any operating stage.

Finally, lock 1 is of straightforward design, reliable, silent-operating and lightweight.

To those skilled in the art it will be clear that changes may be made to lock 1 as described and illustrated herein without, however, departing from the scope of the present invention.

For example, lock 1 may be formed in one piece, i.e. with all the component parts housed in a single supporting member. Arrest of control member 86 in said limit stop positions may be achieved using mechanical stop means secured to supporting member 4, and designed to intercept respective means integral with control member 86, e.g. appendixes formed on one of projections 88, 89 or elsewhere on said member 86. In this case, actuator 84 will conveniently be controlled by control system 110 via timers designed to arrest actuator 84 after a time interval sufficient for enabling control member 86 to move into said limit stop position.

I claim:

1. An electrically operated lock for the door of a motor vehicle having peripheral elastic sealing means designed to cooperate in sealing manner with said door, said lock comprising:

a latch pivoting on a pin integral with said door, and designed to move between a first open position and a second closed position wherein it engages a respective striker on a fixed portion of said vehicle:

a retainer designed to cooperate with and maintain said latch in said closed position by virtue of elastic means;

means for mechanically activating said retainer;

electric activating means; and means for controlling said electric activating means;

characterised by the fact that it comprises control means (86, 18) activated by said electric activating means (84) and secured to said retainer (11); said control means (86, 18) being designed to provide for reversible movement of said retainer (11) for further rotating said latch (9) from said second closed position to a third closed position wherein the load on said peripheral sealing means is increased.

2. A lock as claimed in claim 1, characterised by the fact that said control means (86, 18) are connected angularly to an output shaft (85) of said electric activating means (84) and comprise at least an eccentric portion (17) on which said retainer (11) pivots.

3. A lock as claimed in claim 2, characterised by the fact that it comprises guide means (37) cooperating with said retainer (11) for determining at least approximately linear motion of the same.

4. A lock as claimed in claim 2, characterised by the fact that it comprises means (90) for selectively connecting said control means (86) to said mechanical activating means (57).

5. A lock as claimed in claim 4, characterised by the fact that said control means comprises cam means (86) designed to cooperate with said selective connecting means (90).

6. A lock as claimed in claim 1, characterised by the fact that said mechanical activating means comprise an opening lever (57) pivoting on a respective pin (40) and designed to cooperate with and release said retainer (11) from said latch (9); and at least a lever (39) for controlling said opening lever (57).

7. A lock as claimed in claim 6, characterised by the fact that said selective connecting means comprise a lever (90) connected in articulated manner to said opening lever (57) and designed to move in relation to the same between a first position, wherein it cooperates with said cam means (86) for transmitting the operating loads of the same to said opening lever (57), and a second position wherein said lever (90) is detached from said cam means (86).

8. A lock as claimed in claim 7, characterised by the fact that it comprises fixed means (49) designed to cooperate with said selective connecting lever (90) during displacement of the same integral with said opening control lever (57), and to move said selective connecting lever (90) from said first to said second position.

9. A lock as claimed in claim 7, characterised by the fact that said cam means comprise a first projection (88) designed to cooperate with a first portion (104) of said selective connecting lever (90) in said first position; and a second projection (89) designed to cooperate with a second portion (98) of said selective connecting lever (90) in said second position, for the purpose of restoring said lever (90) to said first position.

10. A lock as claimed in claim 9, characterised by the fact that said control means (86, 18) comprises a pin (18) having said eccentric portion (17) on which said retainer (11) pivots; and a control member (86) having a tubular portion (87) connected prismatically to said pin (18) and to said output shaft (85) of said electric activating means (84); said first and second projections (88, 89) extending radially from said tubular portion (87) of said control member (86).

11. A lock as claimed in claim 1, characterised by the fact that said control means controlling said activating means comprise means (106) for detecting the position of said latch (9); means (105) for detecting the position of said opening lever (57); means for detecting the angular travel of said output shaft (85) of said electric activating means (84); and an electronic control system (110).

12. A lock as claimed in claim 11, characterised by the fact that said electric activating means (84) are controlled by said control system (110) in such a manner that said output shaft (85) is turned 180° commencing from said second closed position of said latch (9), subsequent to which said latch (9) is set by said retainer (11) into said third closed position; and in such a manner that said output shaft (85) is turned 180° in the opposite direction subsequent to manual operation of said opening lever (57) during which said retainer (11) allows said latch (9) to move gradually back to said second closed position, and is released from said latch (9) for enabling the same to return to said first open position.

13. A lock as claimed in claim 12, characterised by the fact that said means for detecting said position of said latch (9) and said opening lever (57) are two microswitches (106, 105).

14. A lock as claimed in claim 1,
characterised by the fact that said electric activating means (84) comprise an electric motor and reduction gear.

15. A lock as claimed in claim 12,
characterised by the fact that said means for detecting angular travel of said output shaft (85) comprise an encoder.

16. A lock as claimed in claim 12,
characterised by the fact that said means for detecting angular travel of said output shaft (85) comprises mechanical stop means designed to cooperate with respective means integral with said control means (86).

17. A lock as claimed in claim 16, characterised by the fact that said electric activating means (84) are controlled by said control system (110) via timers.

* * * * *